US012066016B2

(12) United States Patent
Moreira et al.

(10) Patent No.: US 12,066,016 B2
(45) Date of Patent: Aug. 20, 2024

(54) RECIPROCATING COMPRESSOR HAVING A SUCTION ACOUSTIC FILTER WITH A FASTENER THAT DEFORMS WHEN IN PLACE

(71) Applicant: NIDEC GLOBAL APPLIANCE BRASIL LTDA, Joinville (BR)

(72) Inventors: Emerson Moreira, Joinville (BR); Ricardo M. Doi, Joinville (BR); Sergio K. Lohn, Joinville (BR)

(73) Assignee: NIDEC GLOBAL APPLIANCE BRASIL LTDA, Joinville (BR)

( * ) Notice: Subject to any disclaimer, the term of this patent is extended or adjusted under 35 U.S.C. 154(b) by 246 days.

(21) Appl. No.: 17/626,426

(22) PCT Filed: Jul. 13, 2020

(86) PCT No.: PCT/BR2020/050255
§ 371 (c)(1),
(2) Date: Jan. 11, 2022

(87) PCT Pub. No.: WO2021/007634
PCT Pub. Date: Jan. 21, 2021

(65) Prior Publication Data

US 2022/0260065 A1 Aug. 18, 2022

(30) Foreign Application Priority Data

Jul. 12, 2019 (BR) ..... 10 2019 014485 8

(51) Int. Cl.
*F04B 39/00* (2006.01)
*F04B 35/04* (2006.01)
(Continued)

(52) U.S. Cl.
CPC ..... *F04B 39/0072* (2013.01); *F04B 35/04* (2013.01); *F04B 39/123* (2013.01);
(Continued)

(58) Field of Classification Search
CPC ..... F04B 39/0072; F04B 19/22
See application file for complete search history.

(56) References Cited

U.S. PATENT DOCUMENTS 5,542,824 A * 8/1996 Lee ..... F04B 39/0072 181/246
6,186,751 B1 * 2/2001 Rigo ..... F04B 39/0072 181/403

(Continued)

FOREIGN PATENT DOCUMENTS

JP S64-003275 A 1/1989
JP H05-099141 A 4/1993

OTHER PUBLICATIONS

International Search Report & Written Opinion of the International Searching Authority issued in PCT Application No. PCT/BR2020/050255, mailed Dec. 1, 2020.

*Primary Examiner* — Nathan C Zollinger
*Assistant Examiner* — Timothy P Solak
(74) *Attorney, Agent, or Firm* — FOLEY & LARDNER LLP

(57) ABSTRACT

A reciprocating compressor is provided. The compressor includes at least one functional assembly integrated by at least one compression cylinder and at least one reciprocating piston; at least one electric motor capable of moving the reciprocating piston inside the compression cylinder; at least one set of valves capable of controlling the flow of fluid entering and leaving the compression cylinder, the valves being arranged in a head of the reciprocating compressor; at least one head cover capable of being arranged next to the head of the reciprocating compressor; and at least one suction acoustic filter integrated by at least one outlet pipe provided with at least one outlet path capable of being
(Continued)

arranged next to the head of the reciprocating compressor. The suction acoustic filter is fastened to the head cover using a fastener.

6 Claims, 3 Drawing Sheets

(51) Int. Cl.

| | |
|---|---|
| ***F04B 39/12*** | (2006.01) |
| *F04B 39/14* | (2006.01) |
| *F04B 39/16* | (2006.01) |
| *F04B 53/00* | (2006.01) |
| *F04B 53/22* | (2006.01) |

(52) U.S. Cl.
CPC ..... *F04B 39/0027* (2013.01); *F04B 39/0061* (2013.01); *F04B 39/14* (2013.01); *F04B 39/16* (2013.01); *F04B 53/001* (2013.01); *F04B 53/22* (2013.01)

(56) References Cited

U.S. PATENT DOCUMENTS

| | | | | |
|---|---|---|---|---|
| 6,641,374 | B2 * | 11/2003 | Kim | F04B 39/125 417/415 |
| 7,959,416 | B2 | 6/2011 | Bosco et al. | |
| 2008/0159881 | A1 | 7/2008 | Bosco | |

* cited by examiner

RECIPROCATING COMPRESSOR HAVING A SUCTION ACOUSTIC FILTER WITH A FASTENER THAT DEFORMS WHEN IN PLACE

CROSS REFERENCE TO RELATED APPLICATIONS

This application is a national stage entry of PCT Application No. PCT/BR2020/050255, filed on Jul. 13, 2020, which claims priority to Brazilian Application No. 10 2019 014485 8, filed on Jul. 12, 2019, the entire contents of which are incorporated herein by reference.

FIELD OF THE INVENTION

The present invention relates to a reciprocating compressor, and more particularly, to an assembly arrangement between the head cover and the outlet pipe of the suction acoustic filter of said compressor, this arrangement taking place through ribs arranged in a housing space and an outlet pipe, and with the application of a pressure fastener.

ELEMENTS OF THE INVENTION

As known by those skilled in the art, reciprocating compressors comprise electromechanical machines capable of altering, in a controlled way, the pressure of a given fluid. Reciprocating compressors are widely applied in refrigeration systems based on the refrigerant fluid temperature change.

Generally speaking, a reciprocating compressor consists of a plurality of components and functional systems that cooperate, with each other, in different ways. In any case, the fundamental construction of reciprocating compressors is widely described in patent technical literature and, therefore, is widely known by those skilled in the art.

Among all the components and functional systems that incorporate a reciprocating compressor, the head cover and the suction acoustic filter are of special interest for the scope of the present invention.

As known by those skilled in the art, the head cover of a reciprocating compressor is the component responsible for aggregating and maintaining the positioning of the entire set of valves in relation to the front end of the compression cylinder, in addition to close said front end of the compression cylinder.

As also known by those skilled in the art, the suction acoustic filter of a reciprocating compressor is the intermediate component between the suction passer and the suction inlet on the compressor head, and its function is to minimize the pressure transients generated in the fluid suction process. It is observed, therefore, that the suction acoustic filter of a reciprocating compressor comprises at least one fluid inlet pathway, at least one pulse reduction chamber, and at least one outlet pathway, which is generally arranged in proximity to the suction inlet on the compressor head.

In this scenario, it is common for the suction acoustic filter to be fastened to the head of the reciprocating compressor, or even to the head cover of the reciprocating compressor.

According to the current prior art, some shapes and constructions, for fastening the suction acoustic filter (especially the outlet region of the suction acoustic filter) in the head cover of the reciprocating compressor, are known. The vast majority of these shapes and constructions involve penetrating elements (such as screws), glutinous resins, or pressure fastener. In general, the fastening of the suction acoustic filter should be sufficient to prevent the mobility during compressor operation, after all, it is known that when the suction acoustic filter presents mobility, due to fastening failure, the dynamic shift thereof, due to operating efforts, is amplified and can act as a potential source of excitation of the acoustic cavity (gas bounded between the compressor housing and the assembly of the internal components), intensifying the resonant effects of the acoustic cavity, which is sufficient to increase the undesirable noise of the compressor. Failure to fasten the acoustic filter can also lead to a leakage of fluid from the inside of the filter into the cavity. Causing a loss of acoustic and thermodynamic efficiency.

The patent document U.S. Pat. No. 7,959,416, for example, describes the fastening of the suction acoustic filter to a head cover using a metal clip, which surrounds a large part of the outlet region of the suction filter and is attached to the ends of the head cover.

Technical solutions conceptually analogous to the object of patent document U.S. Pat. No. 7,959,416 are also known by those skilled in the art.

Although these solutions can fasten the suction acoustic filter to the head cover in a fair and controlled way, it is undeniable to note the thermal penalties associated with this constructive concept.

This is because, when the reciprocating compressor is in operation, the temperature of the head cover tends to rise considerably, reaching temperatures much higher than the temperature of the suction acoustic filter. In this context, it is important to comment that the higher the temperature of the suction refrigerant fluid (which passes through the suction acoustic filter before reaching the compression cylinder), the lower the cooling efficiency of the reciprocating compressor. Therefore, it is interesting to minimize the mechanical contact of the suction muffler with the cylinder cover.

In the case of the technical solution of the aforementioned document U.S. Pat. No. 7,959,416, the metal clip increases the heat exchange between the head cover and the acoustic filter. This clip allows the heat exchange through the conduction mechanism between the hot region (cylinder cover) to the cold region (muffler), which in itself is undesirable, causing a concentration of heat to occur especially located in the output of the suction acoustic filter and decreasing the efficiency of the compressor.

It is based on this scenario that the invention under consideration arises.

OBJECTIVES OF THE INVENTION

Thus, the main objective of the present invention is to present a reciprocating compressor whose fastening method between the suction acoustic filter and the head cover is conceptually robust, efficient and does not bring thermal penalties to the overall efficiency of the cooling system.

It is also one of the objectives of the invention under consideration that the fastening method between the suction acoustic filter and the head cover does not allow failures, which are capable of increasing the noise of the compressor.

Consequently, it is also one of the objectives of the present invention that the fastening method between the suction acoustic filter and the head cover minimizes the heat exchange between both.

It is also one of the objectives of the invention under consideration that the fastening method between the suction acoustic filter and the head cover does not impair the exposure between the said suction acoustic filter and the internal environment of the hermetic housing of the reciprocating compressor.

SUMMARY OF THE INVENTION

All the aforementioned objectives are achieved through the reciprocating compressor disclosed herein, which comprises at least one functional set integrated by at least one compression cylinder and at least one reciprocating piston, at least one electric motor capable of moving the reciprocating piston inside the compression cylinder, at least one set of valves capable of controlling the flow of fluid entering and leaving the compression cylinder arranged in the head of the reciprocating compressor, at least one head cover capable of being arranged next to the head of the reciprocating compressor and at least one suction acoustic filter integrated by at least one outlet pipe provided with at least one outlet path capable of being arranged next to the head of the reciprocating compressor, said suction acoustic filter being fastened to the head cover using a fastener.

According to the invention under consideration, the head cover comprises a housing space adapted to accommodate, at least partially, the outlet pipe of the suction acoustic filter, the housing space being defined and delimited by an edge segment of the head cover and by a wall segment of the head cover, and said wall segment being further integrated by at least two ribs facing into the housing space of the head cover. Also according to the invention under consideration, the suction acoustic filter comprises an interface wall arranged in at least a section of the lateral contour of the outlet pipe, said interface wall provided with at least two ribs facing away from the outlet pathway. Also according to the invention under consideration, the fastener comprises a deformable metal element, with contour analogous to the contour of the housing space of the head cover.

It is also noted that the ribs of the wall segment of the head cover and the ribs of the interface wall of the outlet pipe of the suction acoustic filter are complementarily aligned. In this context, the fastener is disposed between the ribs of the wall segment of head cover and the ribs of the interface wall of the outlet pipe of the suction acoustic filter in order to be deformed when the outlet pipe of the suction acoustic filter is juxtaposed to the housing space of the head cover.

BRIEF DESCRIPTION OF THE FIGURES

The preferred embodiment of the invention under consideration is described in detail based on the figures listed, in which.

DETAILED DESCRIPTION OF THE INVENTION

Following the general objectives of the present invention, a reciprocating compressor is revealed whose assembly arrangement between its head cover (1) and the outlet path (41) of its suction acoustic filter (3) are free from the thermal problems present in the technical solutions that integrate the current prior art.

In this context, a reciprocating compressor is revealed whose suction acoustic filter (3), fastened to the head cover (1), has a heat exchange especially favored with the internal environment of the airtight housing (cold environment) and not with the head cover (1) itself (warm environment).

Figure 5:
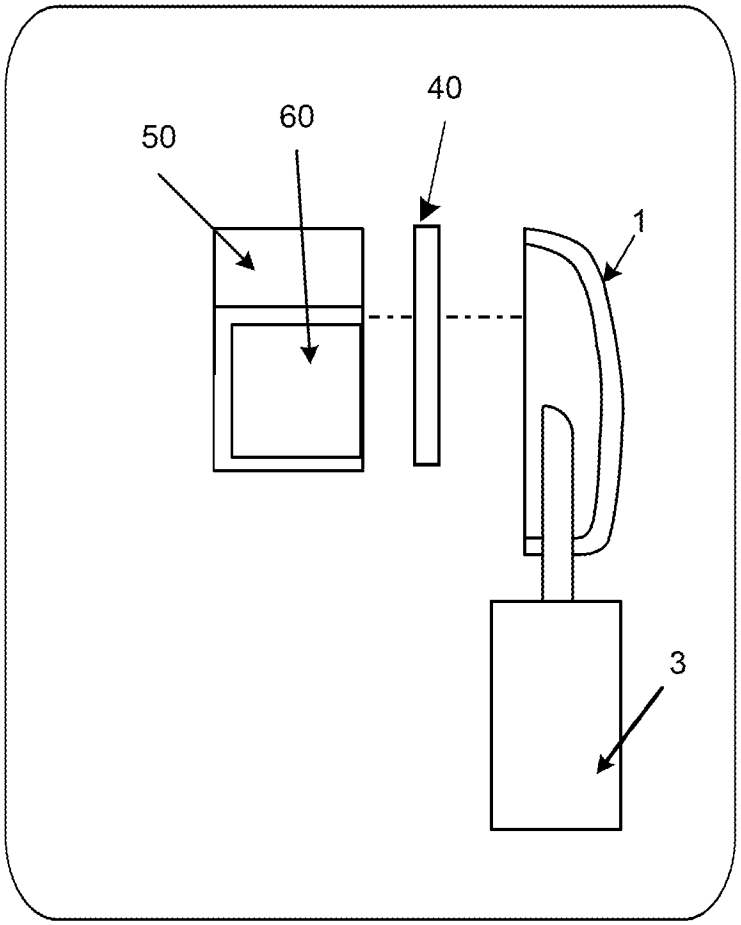
FIG. 5 illustrates, in block diagram form, the assembly of the head cover with components including the piston and the cylinder.

For the sake of sufficiency of description, it is worth mentioning that the technical solution presented here is applied to all reciprocating compressors, preferably used in any type of refrigeration system, minimally composed of a functional set integrated by at least one compression cylinder (50) and by at least one reciprocating piston (60), an electric motor capable of moving the reciprocating piston inside the compression cylinder and at least one set of valves (40), as shown in FIG. 5. The valves (40) are capable of controlling the flow of fluid entering and leaving the compression cylinder arranged in the head of the reciprocating compressor, the head having a head cover (1) as further shown in FIG. 5. It is worth emphasizing that all these systems and components, as well as their functional principle, are widely known by those skilled in the art.

More particularly, the technical solution presented here is especially applied in a reciprocating compressor provided with at least one head cover (1) capable of being arranged next to the head of the reciprocating compressor and at least one suction acoustic filter (3) which, integrated by at least one outlet pipe (4) provided with at least one outlet path (41) capable of being arranged next to the head of the reciprocating compressor, it is fastened to said head cover (1) using a fastener (6). The outlet pipe (4) of the suction acoustic filter (3) has a front interface (43) and a rear interface (44).

Thus, although it is capable of solving an efficiency question of the reciprocating compressor as a whole, the technical solution presented here is particularly focused on the form of attachment between the suction acoustic filter (3) and the head cover (1). This means that the technical solution under consideration aims to optimize the general concept of the technical solution described in document U.S. Pat. No. 7,959,416.

Figure 1:
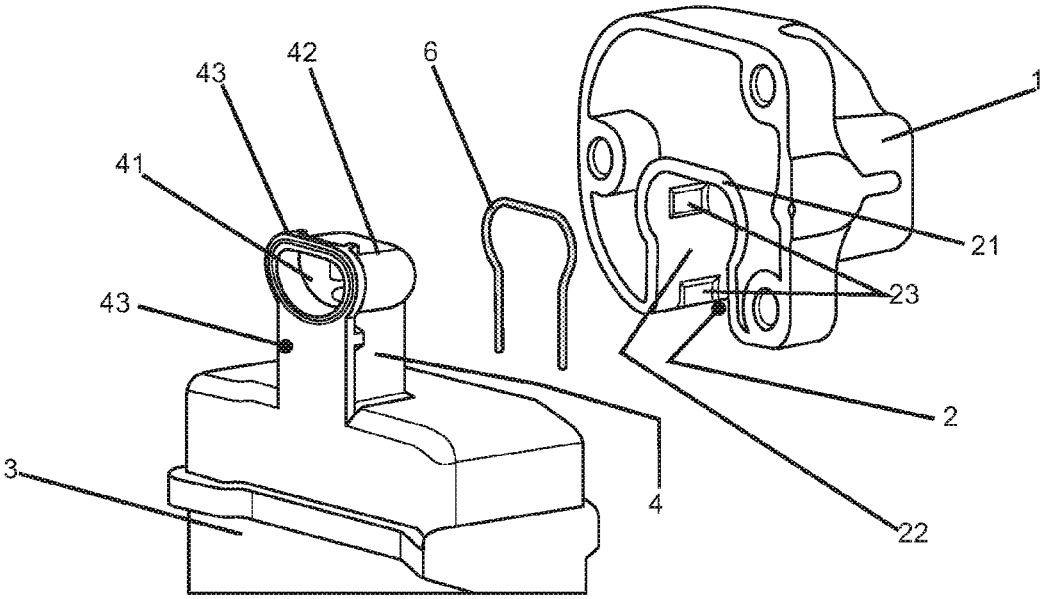
FIG. 1 illustrates, in an exploded perspective, the details of the assembly arrangement between the head cover and the outlet duct of the suction acoustic filter of the reciprocating compressor, according to the invention under consideration.

In FIG. 1, it is noted that the head cover (1) comprises a housing space (2) which is specially adapted to accommodate, at least partially, the outlet pipe (4) of the suction acoustic filter (3). Here it is worth mentioning that the general shape of the housing space (2) can vary, as long as it is in accordance with the general shape of the outlet pipe (4), so that the housing space (2) can adequately accommodate the outlet pipe (4) of the suction acoustic filter (3).

Figure 3:
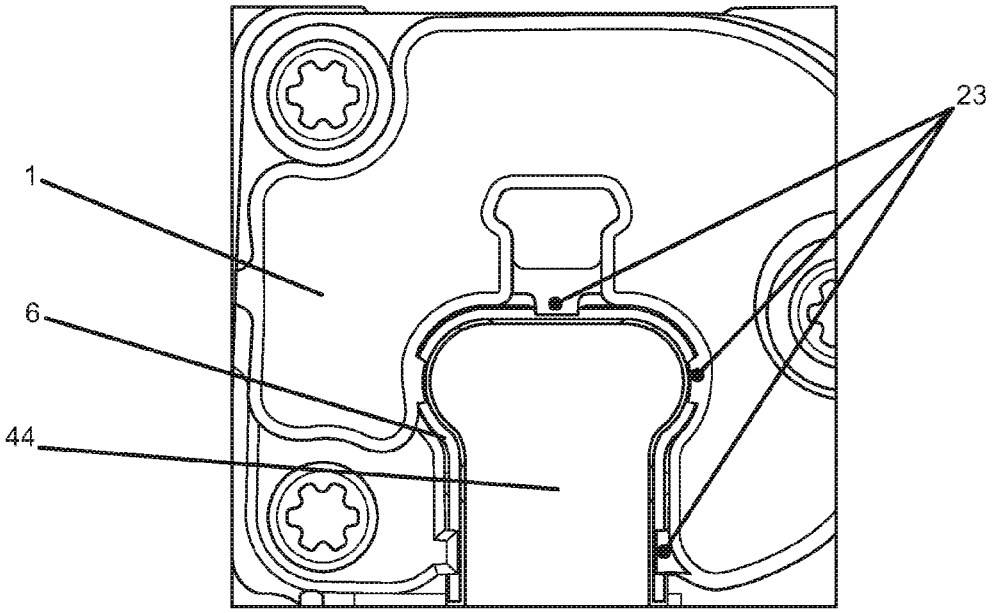
FIG. 3 illustrates, in planed view, the assembly between the head cover and the outlet duct of the suction acoustic filter of the reciprocating compressor, according to the invention under consideration, under the perspective of the faces of these components that are exposed to the internal environment of the hermetic housing of said compressor.
Figure 4:
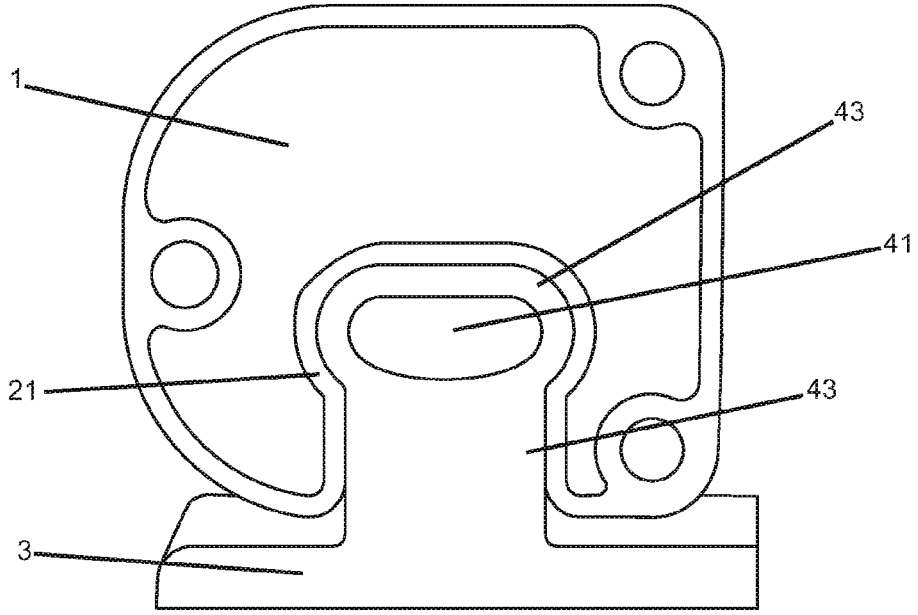
FIG. 4 illustrates, in planned view, the assembly between the head cover and the outlet duct of the suction acoustic filter of the reciprocating compressor, according to the invention under consideration, under the perspective of the faces of these components that are exposed to the head of the compressor.

To house the outlet pipe (4) in the housing space (2) these components are juxtaposed through a sliding fit, that is, when positioning the outlet pipe (4) next to the housing space (2), simply slide the pipe into the accommodation. As can be seen in FIGS. 3 and 4, the outlet pipe (4) within housing space (2) have similar shapes which allow the engagement by sliding through the outlet pipe (4) without difficulty, within the housing space (2).

It is important to highlight that the housing space (2) is defined outside the useful area of the head cover (1), that is, the housing space 2 does not cause damage or interfere with fundamental functions of the head cover (1).

Also, as noted in FIG. 1, the housing space (2) is defined and delimited by edge segments (21) of the head cover (1) and by wall segments (22) of the head cover (1). Preferably, the edge segments (21) are aligned to the edge of the head cover (1), these edges defining the same plane. In another preferred embodiment, the edge segments (21) do not define the same plane with the edge of the head cover (1).

It can also be seen in FIG. 3 that the said wall segment (22) is preferably integrated by five ribs (23) facing into the housing space (2) of the head cover (1).

Figure 2:
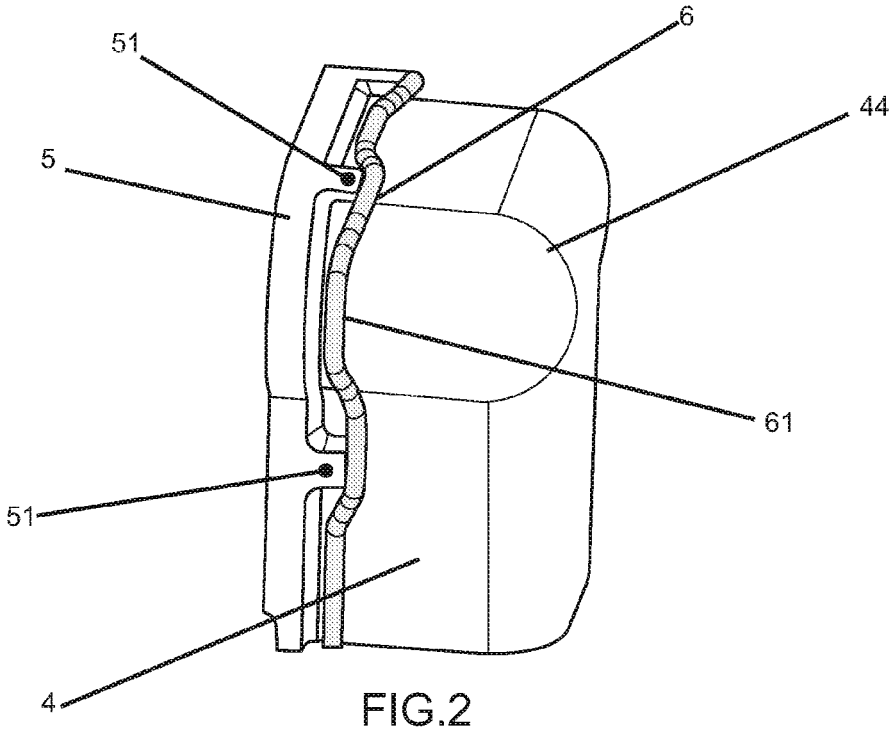
FIG. 2 illustrates, in perspective, constructive details of the outlet duct of the suction acoustic filter of the reciprocating compressor, according to the invention under consideration.

In turn, it can be seen in FIG. 2 that the suction acoustic filter (3) comprises an interface wall (5) arranged in at least a section of the lateral contour of the outlet pipe (4). It can be seen in FIG. 3 that the said interface wall (5) is preferably provided with four ribs (51) facing in the opposite direction to the direction of the outlet path (41).

The ribs (23) of the wall segment (22) of the head cover (1) and the ribs (51) of the interface wall (5) of the outlet pipe (4) of the suction acoustic filter (3) are complementarily aligned so that, when sliding fit, each rib (23) will be arranged between two ribs (51). In other words, the ribs (23) and (51), when assembling the outlet pipe (4) in the housing space (2), are side by side, alternating mutually. It is worth mentioning that the ribs (23) and (51), when assembling the outlet pipe (4) in the housing space (2), do not remain juxtaposed, that is, there is a gap/spacing between them.

It should be highlighted that the geometry and dimensions of the ribs (23) of the wall segment (22) of the head cover (1) and the ribs (51) of the interface wall (5) of the outlet pipe (4) of the suction acoustic filter (3) can vary without prejudice to the arrangement of the assembly now proposed.

In a preferred embodiment, five ribs (23) (two ribs in each side of the wall segment (22) and one rib in the upper of the wall segment (22)) are provided for the head cover (1), and four ribs (51) in the interface wall (5) are arranged in at least a section of the lateral contour of the outlet pipe (4).

In a minimalist solution, the head cover may have at least one rib and the acoustic filter may have at least two ribs or vice versa. The increase in the number of ribs improves the fastening of the acoustic filter.

Again looking at FIG. 2, it can be seen that the suction acoustic filter (3) is attached to the head cover (1) with the additional aid of a fastener (6), this fastener (6) being deformable, with contact analogous to the contour of the housing space (2) of the head cover (1).

In particular, the fastener (6) is arranged between the ribs (23) of the wall segment (22) of the head cover (1) and the ribs (51) of the interface wall (5) of the outlet pipe (4) of the suction acoustic filter (3), in order to be deformed when the outlet pipe (4) of the suction acoustic filter (3) is juxtaposed to the housing space (2) of the head cover (1). More specifically, the fastener (6) is positioned so that it is tightened, pressed between the ribs (51) of the interface wall (5) and the ribs (23) of the wall segment (22).

In an alternative embodiment, an additional fastening component can be applied to the fastener (6), such as an adhesive component.

It should be noted that the arrangement of the ribs (23) and (51), which are complementarily aligned, allows deformations to be distributed along with the fastener (6). This generates uniform and efficient attachment pressure of the acoustic filter pipe. Furthermore, by housing the outlet pipe (4) within the housing space (2), each rib (23) of the wall segment (22) causes a deformation segment in the fastener (6). This deformation generates a deformed segment (61), as can be seen in FIG. 2. It is clear that each deformed segment (61) of the fastener (6) is disposed between two ribs (51) of the interface wall (5) of the outlet pipe (4).

The deformation in the fastener (6), occurred by the ribs (23) and (51), allows the assembly arrangement proposed here to be practically immobile, avoiding mobility during the operation of the compressor, as well as avoiding failure of the fastening and the dynamic displacement due to the operating efforts.

Still, and as can be seen in FIGS. 3 and 4, the reciprocating compressor with the proposed assembly arrangement allows a large region of the suction acoustic filter (3), especially the outlet pipe (4), the front interface (43) and the posterior interface (44), to be exposed to the internal environment of the hermetic housing, which has a temperature that is lower than the temperature of the cylinder cover, a fact that generally increases the efficiency of the compressor. In addition, this configuration of the assembly arrangement allows the suction acoustic filter (3) to have minimal mechanical contact with the cylinder cover, thus reducing thermal exchanges with it.

Finally, it should be highlighted that when the outlet pipe (4) is juxtaposed to the housing space (2), disposed between the ribs (51) and (23), a deformed segment (61) of the fastener (6), is formed. This segment can be formed through elastic and/or plastic deformations in the fastener (6).

Such an assembly configuration, as described, allows the assembly arrangement between the outlet pipe (4) of the suction acoustic filter (3) and the head cover (1) to be robust, efficient, do not bring thermal penalties to the overall efficiency of the cooling system, do not allow failures, which are capable of increasing compressor noise, and minimize the heat exchange between the suction acoustic filter (3) and the head cover (1).

It is important to highlight that the description above has the sole purpose of describing, in an exemplary form, the particular embodiment of the invention under consideration. Therefore, it is clear that modifications, variations, and constructive combinations of elements that perform the same function in substantially the same way to achieve the same results, remain within the scope of protection defined by the attached claims.

The invention claimed is:

1. A reciprocating compressor comprising:

at least one functional assembly integrated by at least one compression cylinder and at least one reciprocating piston;

at least one electric motor capable of moving the reciprocating piston inside the compression cylinder;

at least one set of valves capable of controlling the flow of fluid entering and leaving the compression cylinder; said set of valves being arranged in a head of the reciprocating compressor;

at least one head cover (1) capable of being arranged next to the head of the reciprocating compressor;

at least one suction acoustic filter (3) integrated by at least one outlet pipe (4) provided with at least one outlet path (41) capable of being arranged next to the head of the reciprocating compressor;

said suction acoustic filter (3) being fastened to the head cover (1) using a fastener (6); said reciprocating compressor being characterized in that:

the head cover (1) comprises a housing space (2) adapted to accommodate, at least partially, the at least one outlet pipe (4) of the suction acoustic filter (3), the housing space (2) being defined and delimited by edge segments (21) of the head cover (1) and a wall segment (22) of the head cover (1), the said wall segment (22) being integral by at least one rib (23) facing into the housing space (2) of the head cover (1);

the suction acoustic filter (3) comprises an interface wall (5) arranged in at least a section of a lateral contour of the outlet pipe (4), said interface wall (5) being provided with at least one rib (51) facing in the opposite direction of the outlet path (41);

the fastener (6) comprises a deformable metallic element, with a contour analogous to a contour of the housing space (2) of the head cover (1);

the at least one rib (23) of the wall segment (22) of the head cover (1), and the at least one rib (51) of the interface wall (5) of the outlet pipe (4) of the suction acoustic filter (3), are complementarily aligned;

the fastener (6) is arranged between the at least one rib (23) of the wall segment (22) of the head cover (1) and the at least one rib (51) of the interface wall (5) of the at least one outlet pipe (4) of the suction acoustic filter (3), in order to be deformed when the at least one outlet pipe (4) of the suction acoustic filter (3) is juxtaposed to the housing space (2) of the head cover (1).

2. Reciprocating compressor according to claim 1, characterized in that the housing space (2) is defined outside the useful area of the head cover (1).

3. The reciprocating compressor according to claim 1, characterized in that the juxtaposition of the at least one outlet pipe (4) of the suction acoustic filter (3) to the housing space (2) of the head cover (1) occurs with a sliding fit of these components.

4. The reciprocating compressor according to claim 1, characterized in that each rib (23) of the wall segment (22) is arranged in a complementary way between two ribs (51) of the interface wall (5) of the at least one outlet pipe (4).

5. The reciprocating compressor according to claim 4, characterized in that each rib (23) of the wall segment (22) causes a deformation segment in the fastener (6), with each deformed segment (61) of the fastener (6) being arranged between two ribs (51) of the interface wall (5) of the at least one outlet pipe (4).

6. The reciprocating compressor according to claim 5, characterized in that, the juxtaposition of the at least one outlet pipe (4) of the suction acoustic filter (3) to the housing space (2) of the head cover (1), is arranged between two ribs (51) of the interface wall (5) of the at least one outlet pipe (4), a deformed segment (61) of the fastener (6) and a rib (23) of the wall segment (22).

* * * * *